United States Patent [19]

Dooley

[11] Patent Number: 4,872,687

[45] Date of Patent: Oct. 10, 1989

[54] PUTTING TUTOR

[76] Inventor: Daniel J. Dooley, 112 Carriage Way - A110, Burr Ridge, Ill.

[21] Appl. No.: 76,877

[22] Filed: Jul. 23, 1987

[51] Int. Cl.[4] ..... A63B 69/36; G01P 3/36

[52] U.S. Cl. ..... 273/185 R; 273/186 R; 273/181 K; 273/179 R; 273/179 E

[58] Field of Search ..... 273/184 R, 184 A, 185 R, 176 FB, 273/181 H, 183 R, 183 A, 221, 26 R; 250/222.2

[56] References Cited

U.S. PATENT DOCUMENTS

| | | | |
|---|---|---|---|
| 2,057,504 | 10/1936 | Schaefer | 273/176 FB |
| 3,306,619 | 2/1967 | Brandall | 273/184 A |
| 3,341,206 | 9/1967 | Ganger | 273/177 B |
| 3,759,528 | 9/1973 | Christophers et al. | 273/185 R |
| 3,892,414 | 7/1975 | Glasson et al. | 273/185 R |
| 4,160,942 | 7/1979 | Lynch et al. | 273/184 R |
| 4,180,726 | 12/1979 | De Crescent | 250/222.1 |
| 4,190,825 | 4/1979 | Wilson | 273/181 H |
| 4,515,365 | 5/1985 | Horikoski | 273/26 R |
| 4,563,005 | 1/1986 | Hand et al. | 273/185 R |
| 4,652,121 | 3/1987 | Kanagawa | 273/26 R |

*Primary Examiner*—William L. Freeh

*Attorney, Agent, or Firm*—Neuman, Williams, Anderson & Olson

[57] ABSTRACT

A device is provided for measuring the direction and estimated distance of travel of a ball such as a golf ball over a generally horizontal surface. The device includes energy absorbing material at the top of a rearwardly sloped back surface for obtaining return of the ball to a starting position.

22 Claims, 7 Drawing Sheets

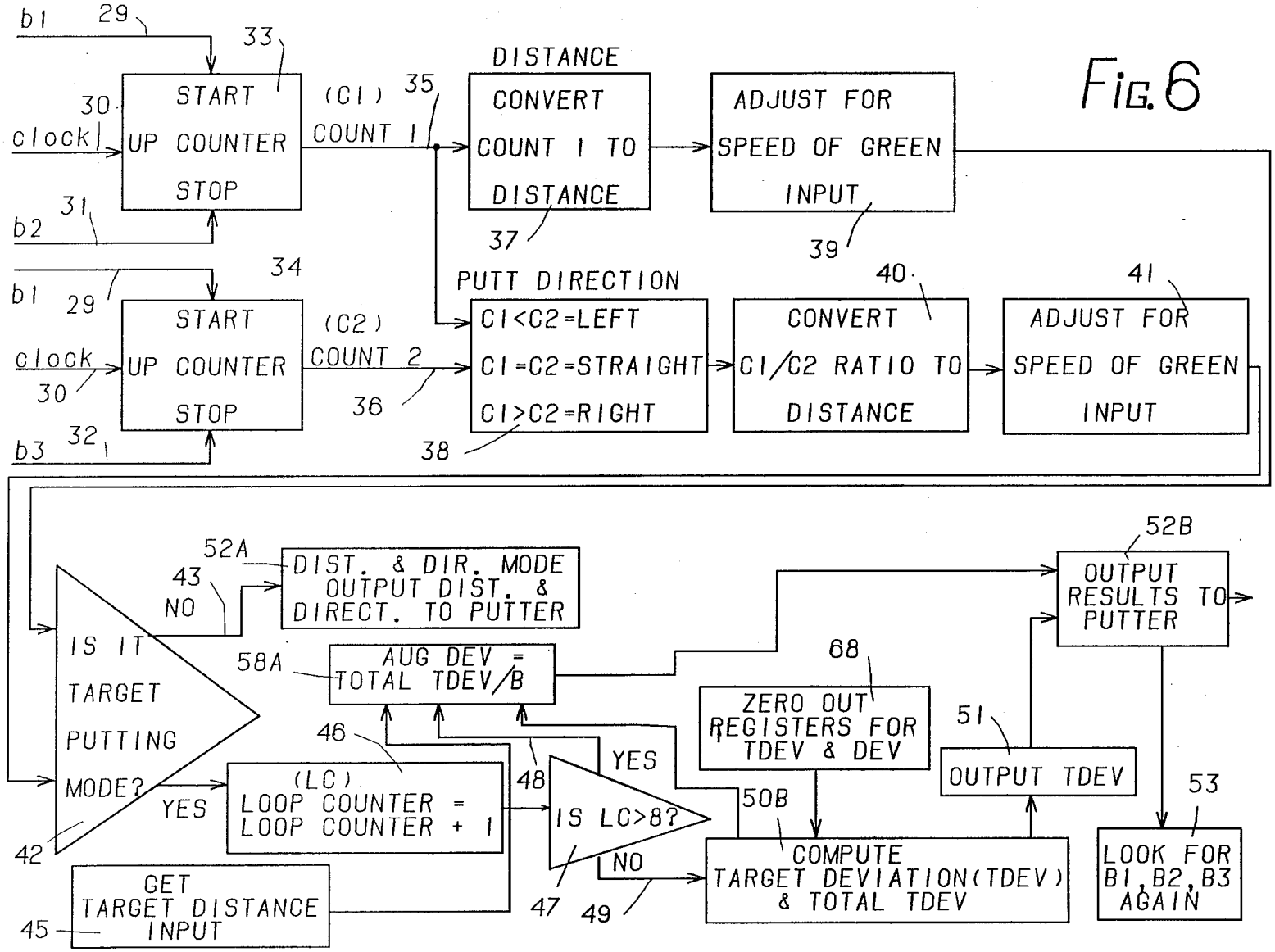
Fig. 6
START
UP COUNTER
STOP
(C1) COUNT 1
(C2) COUNT 2
b1
clock
b2
b3
DISTANCE
CONVERT COUNT 1 TO DISTANCE
ADJUST FOR SPEED OF GREEN INPUT
PUTT DIRECTION
C1<C2=LEFT
C1=C2=STRAIGHT
C1>C2=RIGHT
CONVERT C1/C2 RATIO TO DISTANCE
ADJUST FOR SPEED OF GREEN INPUT
DIST. & DIR. MODE OUTPUT DIST. & DIRECT. TO PUTTER
AUG DEV = TOTAL TDEV/B
IS IT TARGET PUTTING MODE?
YES
NO
(LC) LOOP COUNTER = LOOP COUNTER + 1
IS LC>8?
YES
NO
ZERO OUT REGISTERS FOR TDEV & DEV
COMPUTE TARGET DEVIATION (TDEV) & TOTAL TDEV
OUTPUT TDEV
OUTPUT RESULTS TO PUTTER
LOOK FOR B1, B2, B3 AGAIN
GET TARGET DISTANCE INPUT

PUTTING TUTOR

This invention is related generally to the field of sports and more particularly to swing or stroke aids for ball oriented sports.

BACKGROUND OF THE INVENTION

Prior swing aids for golfers or the like have included a variety of different devices. For example:

(a) One device can be set upon a surface and is designed to trap a golf ball inside itself in an area approximating the opening of a regulation golf cup.

(b) Other devices can be set upon a surface and have openings at least the size of the diameter of a golf cup. A golf ball that has rolled directly into one of these devices' openings rolls back into a golf ball-sized cavity at the rear of the device and moves the piston of an electro-mechanical solenoid far enough back that an electrical contact is made which energizes the solenoid's coil, propelling the piston forward. At the same time the golf ball resting on the piston is propelled backwards out of the machine; another similar device has an upwardly-inclined ramp, usually ten to fifteen feet in length, that has a recessed golf cup near its elevated end. A golf ball is set at the bottom of a green-carpeted ramp and is propelled up the ramp and into the recessed cup; if it does go into the cup an internal shoot guides the golf ball back to the hitting area. If the golf ball travels too far, it settles onto another ramp that carries the ball to the internal chute. If the ball does not go up the ramp far enough, it falls back down the ramp towards the bottom.

(c) Still further devices have a mat-like surface with a series of rows of optical and/or magnetic sensors embedded therein that are designed to catch the reflection of light off a piece of reflective tape and/or to interact with magnetic tape attached to the bottom surface of a moving golf club. The devices typically provide information that relates to (a) the speed of the moving club, (b) the distance the ball would travel if a club was swung at that speed and (c) the direction the club was moving, either an inside-out path, a straight path, or an outside-in path.

Each of these devices has certain limitations. The device that attempts to trap the ball inside itself, such as (a) above, will not trap a golf ball that is rolling straight on-line if it is travelling fast when it arrives. Also, once the golf ball has stopped, someone has to walk to the ball and retrieve it if the ball is to be replayed. For devices such as those described in paragraphs (a) and (b) above, an errant shot to the left or right of the device creates no indication as to how far away from the intended target it ended up. Most of the devices that are included in paragraphs (a) and (b) above must rely on the surface at hand, be it a deep, textured, bumpy carpeting or a floor covered with linoleum to simulate the smoothness and pace of a real grass golf green.

Devices that are described in paragraph (b) above do not return errant shots, and a golf ball on-line can jump over the back of the device if it has a little extra velocity. Also, the solenoids misfire or do not catch the golf ball squarely all the time, causing the golf ball to return improperly.

The length of a putt that can be practiced by devices described in (a) and (b) above is limited by the length of clear, unimpeded surface available and the length the user wants to travel to retrieve the golf balls. Also, the area being used is restricted from being utilized in other ways.

The devices described in paragraph (c) above are not portable or easy to move; they restrict the use of the area they're in permanently, and they cannot be conveniently used in two separate locations, such as home and office. A golf ball hit too hard can jump over the back ramp, or it can become stuck in the internal shoot, halting the ball return system until a manual extraction is performed. The length of the putt to be practiced is limited by the ten to fifteen foot length of the device. The devices that are described in paragraphs (a), (b) and (c) all have the same drawback in that different putt speeds cannot be simulated unless a drastic change in the surface used is made.

Devices such as those described in paragraph (d) above do not ascertain information about the golf shot directly from sensing the movement of the golf ball but take the indirect approach of detecting club head movement. A golf shot that is mis-hit cannot be diagnosed by examining club head movement on a horizontal plane only. A golf ball can be hit after the club head has recocheted off the surface behind the golf ball, imparting an upward blow, or a golf ball can be hit with a downward descending blow. The two swings register the same information when only being detected from a horizontal plane, while the actual results of the ball flight would be tremendously different. Also, the golf club being used must be altered by placing a piece of reflective or magnetic tape on the bottom of it. If the placing of the tape is forgotten, valuable time can be wasted until this fact is realized. In many instances a lightweight plastic ball has to be used because the movement of a regulation golf ball may cause considerable damage to life and property. The degree to which off-line club path movement can be detected is severely limited by the spacing and number of sensors used. The golf ball that is hit does not automatically return to the place from which it was hit. The putt swing, which is certainly not a full swing, is not readily detectable, and the small incremental measurements necessary for accurate putt analysis are not inherent in these devices.

Finally, all of the devices mentioned above have the drawback that any information has to be discerned by lifting of the head and the use of considerable eye movement. All the teachings on golf agree on the necessity to limit head movement, and especially upward head movement, to an absolute minimum.

THE PRESENT INVENTION

The present invention was evolved with the general object of overcoming the disadvantages of prior swing practice devices and of providing a device that allows a person to practice any length of putt in a small amount of space, with an ability to simulate any space of green a golfer may encounter on any golf course and to give precise, accurate information on the putt's distance and deviation from the intended target.

The invention is a compact device that uses any golf ball struck by any putting club. In its preferred form it has a sensor housing into which the ball is struck from close range, and, as an extendable part thereof, a surface made of a durable, green-colored fabric-like material that has the look and feel of a close cut putting green.

Another object of the invention is to provide an instrument that can be used with any putter without affixing any foreign substance to it. It has been found that for a specific person one putting club can be more accurate at longer distances (40 feet, for instance) than at shorter distances (10 feet, for instance), and a different putting club may be more accurate for shorter putts than for longer putts. In one preferred embodiment the invention is constructed in such a manner that a golf ball that is hit with such velocity that it would travel over 150 feet on a putting green and a golf ball that is hit with such velocity that it would travel but 5 feet would both gently return to the back of the invention's surface to the point from which they were hit.

Another object is to provide a ball return mechanism that is not only functional but also inexpensive to manufacture and quick to assemble.

Another object of the invention is the provision of a precise and accurate non-obtrusive means of determining the speed of the golf ball and the amount its path varies from the ideal path (which would be a straight path inside the sensor housing equally distant from the left and right wall of said housing). In accordance with one aspect of the invention, means are provided to electronically detect distance and direction for a given putt.

More specifically, the principal embodiment of the present invention is a swing or stroke aid that is specifically designed for the golf putting swing. It is a compact device that includes a putting surface uniquely attached to a three-sided sensor housing that has on top of it a box containing electronics, switches and a speaker. The invention uses direct current to power its electronics and its sensors. The sensors consist of 3 pairs of infrared emitters and detectors that are positioned so that 3 coherent, radiation beams sense a golf ball that has been hit by a putting club. The device is so constructed that the hit golf ball returns to the position from which it was hit. Putts of any length can be practiced. The invention can simulate the act of putting on greens of differing pace merely by turning a potentiometer that is calibrated to the "Stimp" meter rating numbers. A straight distance and direction mode is available along with a target putting mode. All results are conveyed to the user of the invention by means of a simulated human voice that is broadcast through the invention's speaker.

The putting surface is attached to the bottom of both sides of the sensor housing to a point after the last sensor. Then the putting surface slants upwards and to the back of the sensor housing where it is attached to the back and to the interior underside of the sensor housing. When a golf ball that is hit rather softly rolls inside the sensor housing, it rolls up the slanted putting surface until it loses momentum and then it travels back down the slanted putting surface picking up enough speed to arrive back at the point where it was hit. A golf ball that is hit rather hard rolls into the sensor housing and up the slanted putting surface until it makes contact with the underside of the back portion of the sensor housing. At that point, the putting surface gives ever so slightly, catching the golf ball between the underside of the sensor housing and the attached putting surface, allowing the golf ball to spend its energy. The pull of gravity then takes over and the golf ball travels down the slanted putting surface towards the point from which it was originally hit.

The sensors are combined with electronics by which the invention is able to translate the speed of the golf ball into a distance the golf ball would have traveled on a putting green and to translate the direction deviation into the distance the golf ball would have been away from a straight path. The accuracy of the invention is such that these distances are calculated to within an inch of golf ball travel.

In accordance with another objective, the invention is able to simulate any pace of green that the user would find on any golf green in existence. This feature allows the user to hone his putting touch for the pace of green which he is going to encounter, not just an arbitrary pace of green that he may not encounter. The pace of a green is able to be measured and standardized by use of a "Stimp" meter. This allows a golf course to determine the pace of its green and have a number that can be used to compare this pace of green with another golf course's or with established goals set by some governing body (the United States Golf Association, for example). The invention takes the distance and direction information that it has calculated for a golf putt and adjusts this information by reading the setting of a potentiometer that is adjusted by the user to simulate different paces of green. This potentiometer is scaled with the span of possible "Stimp" meter rating numbers. Many, if not all golf courses, have knowledge of their "Stimp" meter rating number. The user of the invention would turn the potentiometer until it is on the "Stimp" meter rating number that corresponds to the number for the greens of the golf course which is of interest to him at the moment. Then the results of his putt will correspond to the results he would obtain if he were putting on the greens at the particular golf course.

The invention also allows the user to set a target distance, then attempt to hit a putt that will result as close as possible to that target distance. The invention calculates the distance and direction of the putt, compares it to the target distance, and informs the user if he is long or short, left or right and how far from the target goal the golf ball would be. If the putt is calculated as ending up left or right within the distance that corresponds to the radius of a golf cup and the putt distance is equal to or less than a short distance more than the target distance, then the user is informed that he has made a "hole in one". By allowing the putt to still be a "hole in one" even though the putt has traveled a slight bit past the target distance simulates the phenomena of a golf ball that is still traveling forward when it arrives at the golf cup dropping into the golf cup after it has hit the back of the golf cup. Target putting allows the user to more readily practice a certain length of putt while at the same time making the deviation calculation for him. This allows the user to concentrate more on his actual putting stroke.

The target putting mode aspect of the invention also allows the user to make a game out of his putting practice. After every 8 consecutive putts in target putting mode the invention informs the user of his average distance deviation for the 8 putts. It does not negate a longer than target putt with a shorter than target putt, which would give the user a false reading of his putting results. The user of the invention thus can easily ascertain, by comparing different average distance deviations, if he is becoming a better putter. The user can also compare his average distance deviation with those of another user, thereby matching his putting skills against those of the other person.

Various alternative embodiments broaden the use of the invention into related fields through the use of personal computers, arcade style electronics, displays and the like.

BRIEF DESCRIPTION OF THE DRAWINGS

FIG. 6 is a flow chart depicting how the sensor output gets converted to distance and direction information and output to the user.

DESCRIPTION OF A PREFERRED EMBODIMENT

Figure 1:
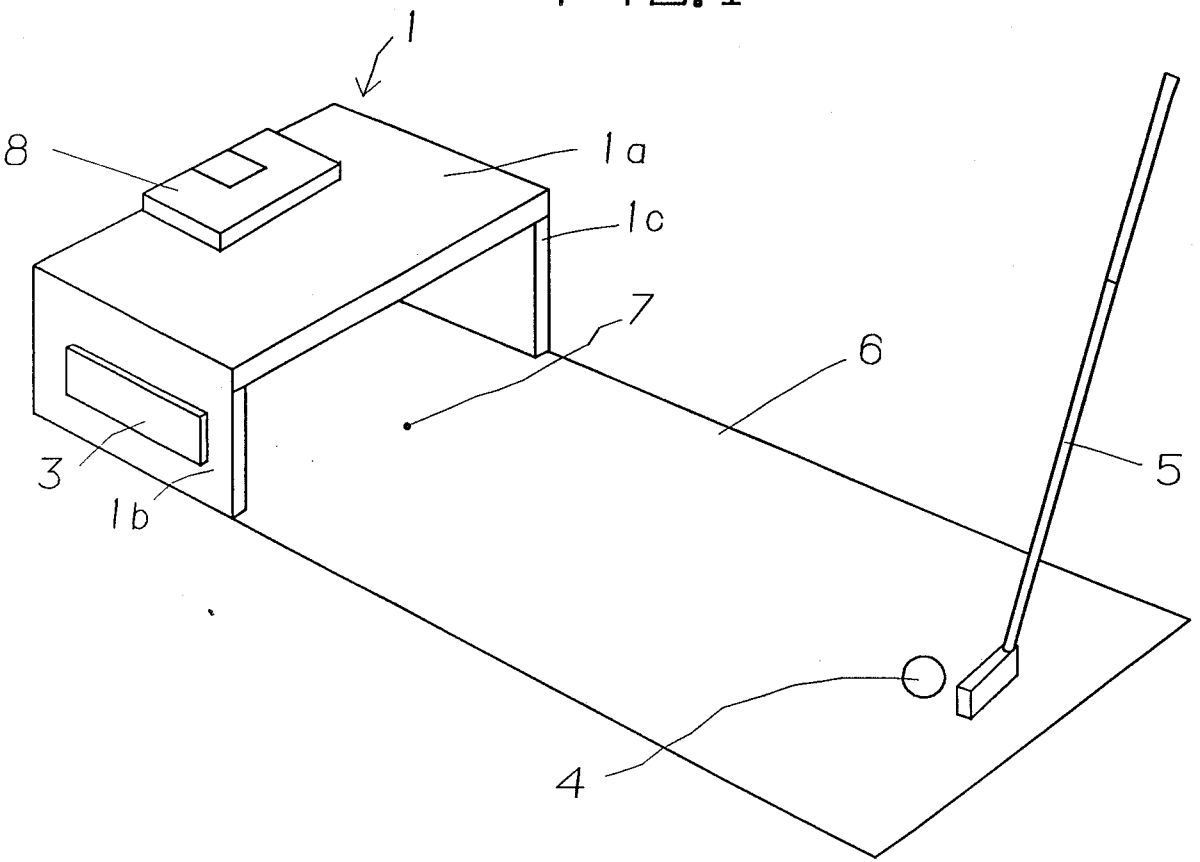
FIG. 1 shows an instrument constructed in accordance with the invention, the instrument being diagrammatically illustrated in use with a putting club in position to hit a golf ball.

Referring to FIG. 1, reference number 1 designates the sensor housing. The top, left wall and right wall of the enclosure 1 are respectively designated 1*a*, 1*b* and 1*c*. In the right wall 1*c* of the sensor housing 1 are located the infrared emitters 2 and in the left wall 1*b* are located the infrared detectors 3. A golf ball 4 is shown at the usual starting position and a putting club 5 is depicted in hitting position behind the ball 4. The putting surface 6 is shown along with the aiming mark 7 which is positioned equidistant between the left and right wall and directly under the front surface of the top 1*a* of the sensor housing 1. Atop the sensor housing 1 is a box 8 containing the electronics, switches, potentiometers and speaker of the invention.

With its surface 6 rolled up for storage or movement, the device, in the preferred configuration, is approximately 18 inches in width by 10 inches in length by 9 inches in height. With the surface 6 fully extended, the device's length is approximately 43 inches in length with a height of 7 inches with the same width of 10 inches. The device weighs less than 8 pounds. Variations of these parameters can, of course, be made within the spirit and scope of the invention.

Figure 2:
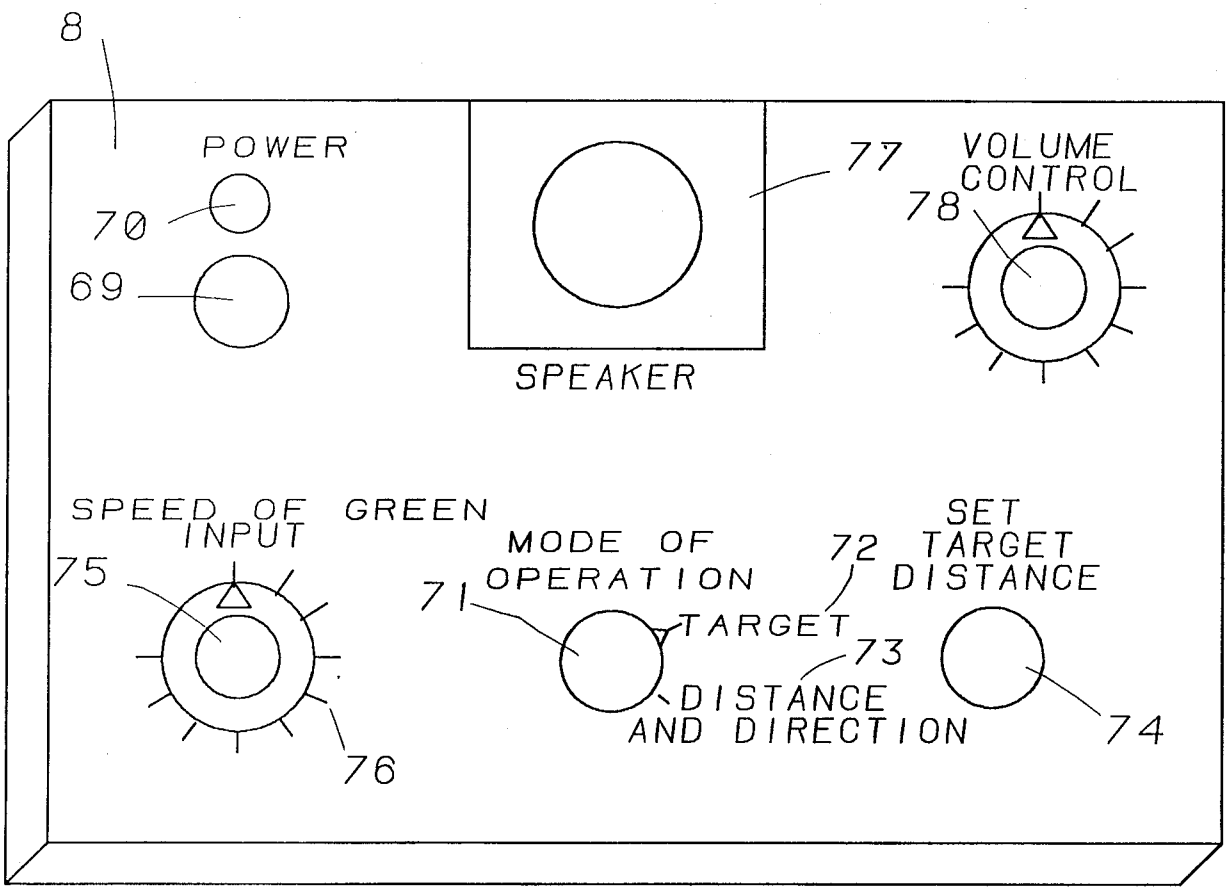
FIG. 2 is an illustration of the box that rests upon the instrument and it shows the various switches, controls and a speaker which are featured on the box.

FIG. 2 is an illustration of the front panel of the box 8 that rests atop the sensor housing 1. The power switch 69 has an ON or an OFF position. When it is in the ON position and D.C. power is applied to the invention, a green L.E.D. 70 turns on and glows. There is a MODE OF OPERATION switch 71 that is either switched to the TARGET MODE 72 or the straight forward DISTANCE AND DIRECTION MODE 73. If the device is in the TARGET MODE 72, then the SET TARGET DISTANCE momentary switch 74 will be inputted to the signal processing circuitry 60. A SPEED OF GREEN INPUT potentiometer 75 can be set, and its scale 76 relates to the "Stimp" meter rating number, well known to golfers and greens experts as a measure of green speed. A VOLUME CONTROL potentiometer 78 is made available to adjust the volume of SSPEAKER 77.

In the preferred embodiment three pairs of infrared emitters and detectors are used. As noted above, the emitters are positioned in holes situated in the right walls of the sensor housings, and the related detectors are situated opposite in holes situated in the left wall of the sensor housing. All of the emitters and detectors are positioned at a height from the putting surface equivalent to half the height of a regulation golf ball. Lenses are used so that a fine, coherent beam of infrared light exists between each pair of emitters and detectors. Two of the beams are parallel to each other and form right angles to the sides of the left and right walls of the sensor housing. The third pair's detector is situated halfway between the other two detectors in the left sensor housing wall and its related emitter is situated farther towards the back of the right wall than the other two emitters. This third beam bisects exactly in half the farther back (beam #2) of the two other beams. By utilizing the ratio of the time the golf ball takes to travel from beam #1 to beam #2 and the time the golf ball takes to travel between beam #1 and beam #3 the invention can ascertain the amount of distance that the golf ball has deviated from the ideal path. If the golf ball has broken the plane of beam #3 before it has broken the plane of beam #2 then the golf ball is traveling left of the ideal path. If the golf ball has broken the plane of beam #2 before it has broken the plane of beam #3 then the golf ball is traveling right of the ideal path. If the golf ball has broken the plane of beam #2 and beam #3 at precisely the same time, then is on the ideal path. By utilizing pairs of infrared emitters and detectors the movement of a regular golf ball that is hit by a regular putting club can be detected without any contact between ball and sensor and without the use of any foreign substance. By ascertaining the time it takes the golf ball to travel between the parallel beams #1 and #2, the invention translates this time into the speed of the moving golf ball.

Figure 3:
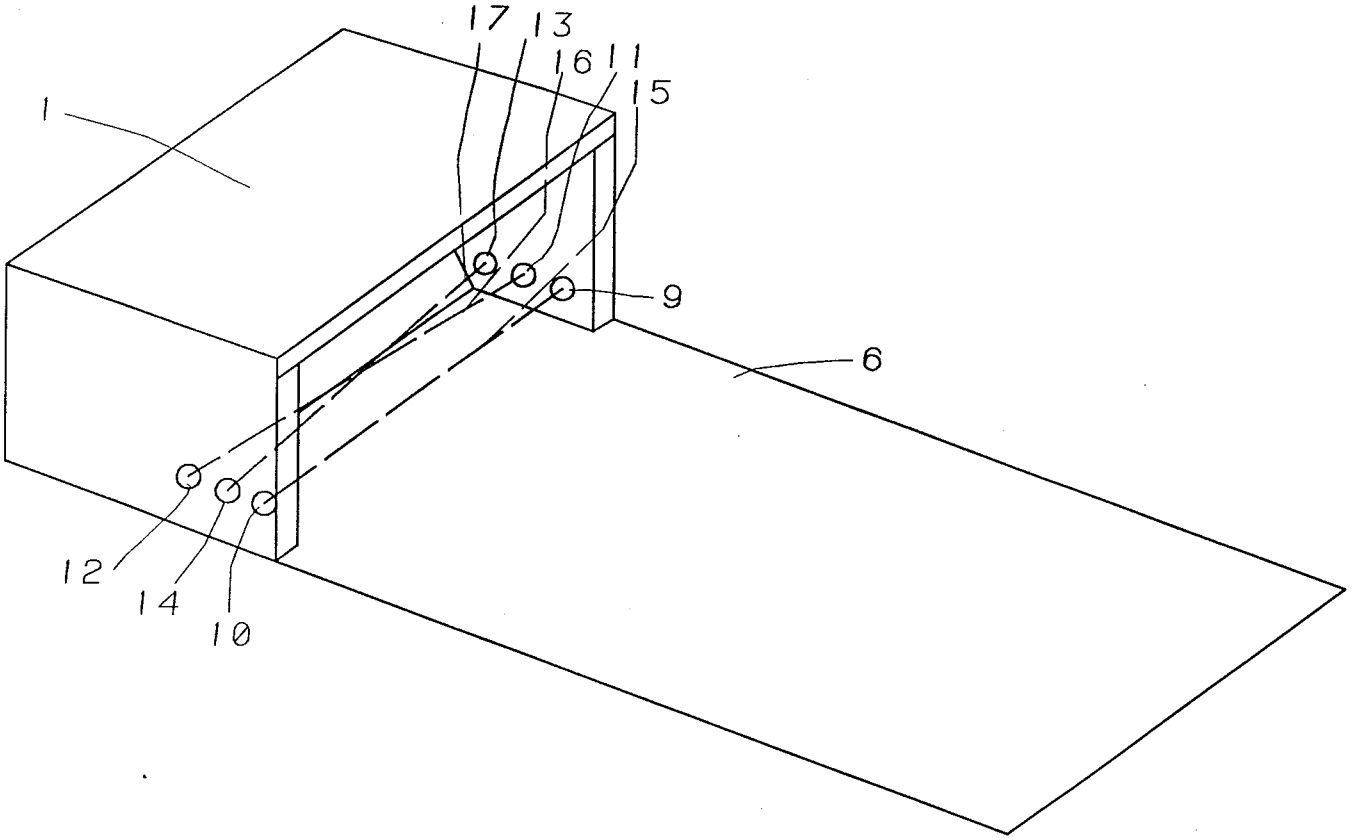
FIG. 3 is a diagram of the infrared sensor positioning along with an illustration of the associated optical beams.

FIG. 3 shows the positioning of the optical sensors within the sensor housing 1. The sensors are all positioned above the putting surface 6 by ½ the diameter of a regulation golf ball 4. Beam 15 comprises the light traveling from the infrared emitter 9 across to infrared detector 10. Beam 16 comprises the light traveling from the infrared emitter 11 across to infrared detector 12. As the illustration shows, beam 15 and beam 16 are parallel to one another. Beam 17 comprises the light traveling from the infrared emitter 13 across to infrared detector 14. Beam 17 bisects beam 16 at its mid-point and extends angularly with respect thereto.

Figure 4:
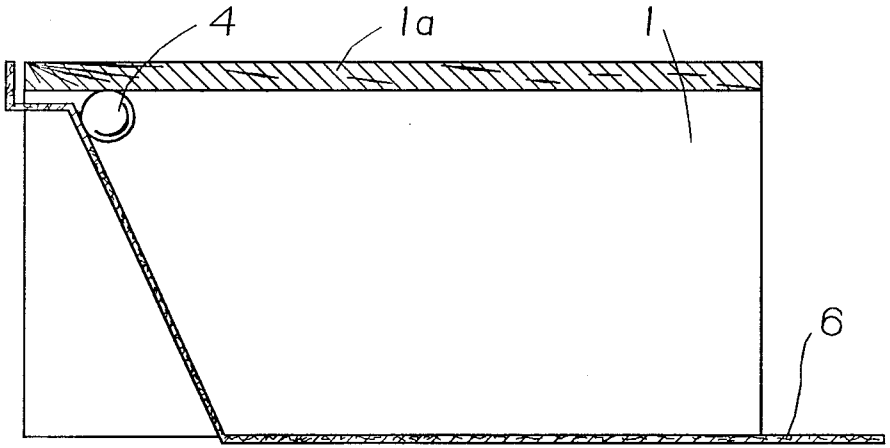
FIG. 4 is an illustration showing how the putting surface is attached to the sensor housing.

FIG. 4 illustrates the unique way in which putting surface 6 is attached to sensor housing 1. From the front edge to a point just past the last sensor under the left and right wall of the sensor housing 1 the putting surface 6 is fixed in a horizontal plane. Back of that point the putting surface 6 is then trimmed back so that it can pass upward and backward inside the sensor housing 1. The putting surface 6 is then affixed to the underside and the back edge of the top portion 1*a* of the sensor housing 1. This unique affixation allows a golf ball 4 traveling at a high rate of speed to be trapped at the upper back edge in the "nip" between the top 1*a* of the housing and the putting surface 6, which absorbs the ball's energy. The angle of return used is approximately 60 degrees. The ball is then released down the slanting putting surface 6 back towards the point from which it was hit. A softly hit golf ball 4 will rise a portion of the way up the slanted portion of the putting surface 6 where the force of gravity will draw the ball downward back towards its starting position. To create consistency in the return of the ball, the top portion 1*a* of the housing is preferably made of an energy absorbing material such as wood or the like; however, the task of absorbing the ball's energy is shared by the top 1*a* and the tendency of the "nip" to temporarily trap the ball at the top of its travel.

Figure 5:
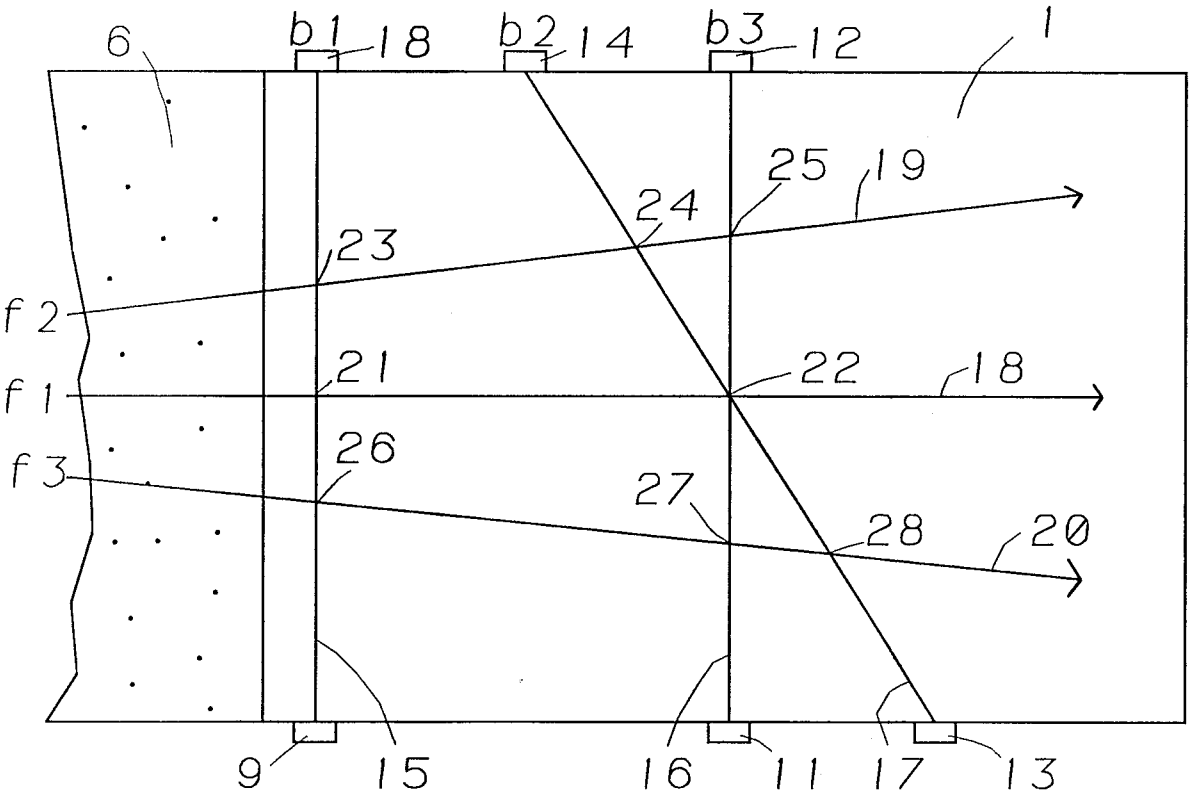
FIG. 5 is an overhead view of three typical paths of a golf ball inside the sensor housing and how these paths intersect the sensor beams.

FIG. 5 is an overhead view showing the outline of the sensor housing 1. It illustrates how a ball following a path f2 19 left of center and a ball hit straight on a path f1 18 and a ball's path f3 20 that is hit right of center each intersect the three beams, 15, 16 and 17. Path f2 19 intersects beam 15 at point 23. It intersects beam 17 at point 24 prior to intersecting beam 16 at point 25, which indicates that it is on a path left of center. Path f3 20, on the other hand, crosses beam 15 at point 26. It then intersects beam 16 at point 27 before it intersects beam 17 at point 28, which indicates it is on a path right of center. Path f1 18 that intersects beam 15 at point 21 and intersects beams 17 and 16 at the same point 22, which indicates that it is a straight path down the center.

FIG. 6 is a flow chart illustrating how the sensor information from infrared detectors 10, 12, and 14 (signals b1, b2 and b3, respectively) is converted into a final output. A clock input 30 increments a pair of up counters 33 and 34 to create counts C1 and C2 respectively. The C1 Count 35, is the result of detector signal b1 (29) starting the up counter 33 and b2 stopping same. C1 35 is then converted to a distance number at 37 relative to the speed of the golf ball 4. This distance number at 37 is then adjusted for the pace of the green at 39 (in response to a manual adjustment 75 by the operator, shown in FIG. 2) and assumes a magnitude DIST. The C2 Count 36 is the result of b1 29 starting the up counter 34 and b3 stopping same. C2 is then compared to C1 35 to arrive at the putt direction, as indicated at 38. The ratio of C1 (35) over C2 (36) is then converted to a direction distance number 40 relative to the distance of the ball's path left or right of center. This direction distance number 40 is then adjusted for the pace of the green input 41 and becomes a number of magnitude designated DIRC.

By checking the input from a mode switch 71 (FIG. 2), the system ascertains if it is in the target putting mode, as shown at 42. If it is not in that mode 43, then the results, DIRC and DIST, are orally output to the user, as shown at 52A. While various types of output devices may be utilized, the preferred form of the invention, discussed below, employs a commercially available voice synthesizer which is programmed to provide the proper output words.

If the mode switch 71 (FIG. 2) is set to "TARGET" putting, as indicated at 44, then the SET TARGET DISTANCE momentary input switch 74 (FIG. 2) is examined 45 until the desired target distance is ascertained. The LOOP COUNTER (LC) is incremented by 1 46 and is checked 47 to see if 8 loops have occurred. If 8 loops have occurred 48, then the average deviation is calculated by taking the total target deviation and dividing it by 8 50A. The target deviation registers are then zeroed out 68. The average deviation is orally output to the user 52B and if less than 8 putting events (loops) have occurred 49, then the current target deviation is computed and accumulated total target deviation is increased by the current target deviation 50B. The target deviation is then output through 51 and 52B. After the user receives his information 52B, the activity then reverts back to the two up counters 33 and 34.

Figure 7:
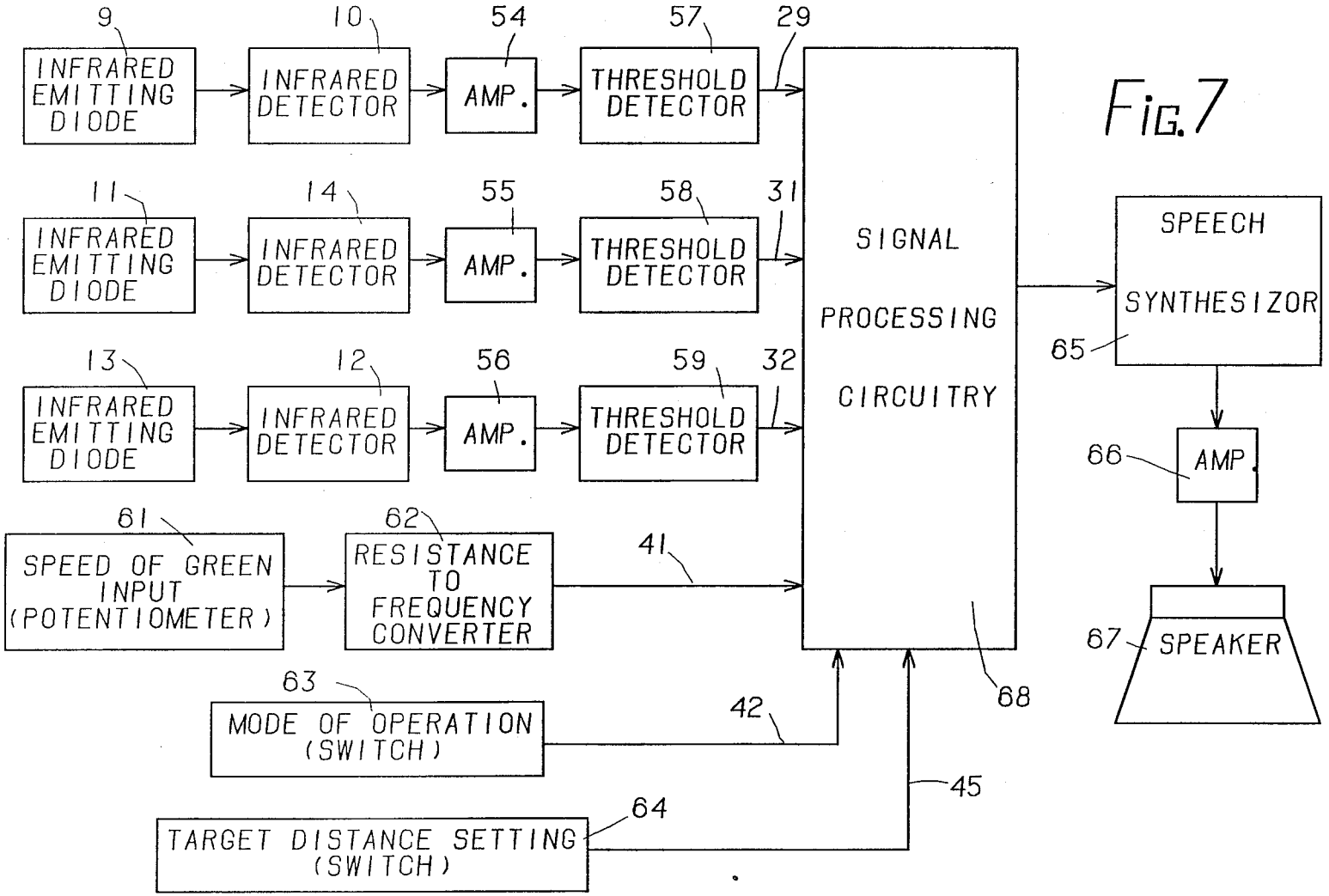
FIG. 7 is a block diagram of the circuitry of the instrument shown in FIG. 1.

FIG. 7 is a block diagram of the circuitry of the invention. The principal element of the circuit is a signal processing circuit 60, which is preferably a microprocessor. Inputs 29, 31 and 32 to the processor come from each of the beam detection channels described above; while inputs 41, 42 and 43 are derived from the green speed setting 61, mode adjustment 63 and the target distance adjustment 64 on the operator's panel (FIG. 2).

Turning first to the beam detection channels, the infrared emitting diode 9 beams radiation in the direction of infrared detector 10. As long as the radiation is not interrupted, the input 29 to the signal processing circuitry 60 is set at 0. If the radiation is interrupted by a moving golf ball 4, the infrared detector 10 output falls towards zero volts. This change of voltage is inverted and amplified in amplifier 54. The altered voltage is then compared in a threshold detector 57 with a threshold voltage set at a trigger point and, if the altered voltage is greater than the trigger point voltage, then an input 29 of 5 volts is delivered to the signal processing circuitry 60. Similarly, the infrared emitting diode 11 beams radiation in the direction of infrared detector 14. As long as the radiation beam is not interrupted, the input 31 to the signal processing circuitry 60 is set at 0. If the beam of radiation is interrupted by a moving golf ball 4, the infrared detector 14 output falls towards zero volts. This change of voltage is inverted and amplified in the amplifier 55. The altered voltage is then compared in a threshold detector 58 with a threshold voltage set at a trigger point and, if the altered voltage is greater than the trigger point voltage, then an input 31 of 5 volts is delivered to the signal processing circuitry 60. Finally, the infrared emitting diode 13 beams light in the direction of infrared detector 12. As long as the radiation source is not interrupted, the input 32 to the signal processing circuitry 60 is set at 0. If the beam of radiation is interrupted by a moving golf ball 4, the infrared detector 12 output falls towards zero volts. This change of voltage is inverted and amplified in an amplifier 56. The altered voltage is then compared in a threshold detector 59 with a threshold voltage set at a trigger point and, if the altered voltage is greater than the trigger point voltage, then an input 32 of 5 volts is delivered to the signal processing circuitry 60.

The speed of green input 61 includes the potentiometer 75 on the operator's panel. The resistance setting of the pot is converted to a frequency in a circuit 62, the output of which is inputted to the signal processing circuitry 60 at input 41 thereto. The mode of operation control 63 is set by a switch 71, which is inputted through path 42 to the signal processing circuitry 60. The target distance setting circuit 64 uses a momentary switch 74 which inputs on a path 45 into the signal processing circuitry 60. As the switch 74 is repeatedly pressed, the target distance is increased incrementally and a voice output indicating that distance is provided.

The signal processing circuitry 60 in the preferred embodiment is an Intel Microprocessor chip, D8749, containing the following hexadecimal machine code:

9aFF99ecc527b87fa0e80862160e09b21f741514-
31f9c6214-
4fBB808F007A084001493345E542A0413262999ef0289-
1083c527-
99fcb807a0e83709B21A863A45890199fe89022762164-
A00095254726D1686044B99fc0aac42ab8902097263168-
6045C99fc0aaf42aebdff048D99fc0aaf42ae89020-
9527C1689047599fc0aac42abbd00048Db9ff83048604-
75fe03ece686832440b807f0afc8-
f0aeba24bb9fb900b800ff370301affe-
371300aefb6fabfa7eaae6CA14C397fbf7abafaf7aaec9E04D8f9f7a9f8f7a88314C3fbc56fd5abfac57ed5aa-
04B8f9adf8ac27aaabfd0300abfc13-
f6aabc0497fa67aafb67abecE9fb0326abfa130-
1aaf8aef9af27adacb830a018a0-
18a018a0b90c340F8327fa67aafb67ab000000f6-
2D97fff7affef7aefdf7adfcf7ace92B83240Fb833f06fa0c8-
f07ea0c8f07da0c8f07ca0241Bfe036eee655-
97fe67aeff67afd5b82fb0ffbc0f0495d5b82fb000bc1-
00495b82ff0c5c66B97fff7affef7aefdb81ac681fba01-
8fca0181818fea018ffa0b8042490fea018ffa0181818fba01-
8fca0b807d527a8a9fb370301abfa371300aabc09ff6b-
affe7aaee6B514C397fff7affef7aeecA024C514C3ff-
c560c8d5affec57018d5ae24AA6490f90339-
a9bd18be00ba00bb00bc0097f9f7a9fef7ae0-
3c7e6E1aefcf7acfbf7abfaf7aaedD5b80297FA67AAFB-
67ABFC67ACE8EEFBAEFCAFB830B940F0AAA1-
1918F0ABA1B830B9042-
7A018E90FB91027ACAD340F00b902b83097f067a01-
8f067a0e91D83B4BF444A53c0f240c64E445697f067a0-
18f067a0c883b83054365436b840543600F8C656b8-
305436b8405436b841547C4BE64bbc5fdd-
5c66D2346142923631429447123 80-
142923441429b831547C54BE83b950bafbbb5054A519b-
affbb8854A5f1c69C079699a119f1030aa1449D0313a119-
bbf454A5f019a18397f06bafc8f07ae6B5a018ffa01144A5-
188314292345142983b950f1c6C954B7231c54B719f1C6-
CF54B719f1c6D754B744E2b950f196E219f196E244E6-
235254B7b953f1c6F154B7235f54B7b804b95027a119e8-
f683237454B7237154B7234b54B7234754B7238c54B-
7233a54B70413237854B7238754B783bd18ba00bb00bc-
00be00b840f0a918f0af97fff7aff9f7a9fef7ae-
03ece63Eaefcf7acfbf7abfaf7aaed2Ffb370301abfa37130-
0aab831f06ba0c8f07aa0e660441B27a018a0441Bb-
831f003fcc8f013ffe673445E234114-
29234254B7232e142923431429235e1429234-
31429230154B783f903e2f6C1f903e8e69F0340a924CBf-
903eee6A90330a924CBf-
903f3e6B30320a924CBf903f8e6BD0310a924CBb90024-
CB24C7400:9425943ad5b870b008f41Df9c610846A149-
3345Eb4B294BAb4037b870f007-
a09609b46D8404234754B7234754B7235254B7230254B-
7235054B783b837b00018b000b90009b243230A54B719-
9484ba1409b260fa54B71a199484-
9D309c665844fD4F374158309B260843A237454B7237-
154B7234b54B7234754B7238c54B7233a54B78409b-
838f00378a0c8f01300a083f0370301aac8f0371300a983b-
8389490b841f06aafc8f079aeb9fff6B9ff370301affe37130-
0aeb90083b830f096DA18f003fcf6DA949Cf-
9c6D4ff03d0fe13fff6D4b980c5bd80d584E2949Cf-
eaaffab94EAf9d38096E883a416-
feb83037030160c6F9e6F7A402a-
40Dff370301186000E60Bb830f0ae18f0afa42584F-
7b830f0aa18f0aba425b83ef06fa0c8f07ea0c8f01300a083-
b80297fa67aafb67abe827ff6baffe7aae83d5f9d38096407-
47383f9c649237954B7a44D236d54B7c5fdd3809656d-
5a464fdd5c660236354B7a464238054B7c5b81f547Cd55-
4BE83b903b83c97f067a018f067a018f067a0e96F234754-
B7234754B723081429234414-
29238b1429238114292344142923505 4B7b83e547C54B-
ED4FFb83cb00018b00018b00083B4BFC4ECB8-
305436B84054368316C1B966B100C9B100BA05231E6-
20937F2CD5509F2D20-
916E437F2D511F196D21911C9A4D2EAD565B966F-
103FCE6F7B80083C416-
C40BC405F103FEE6F396F5C9F11903EAE609B8F5-
C492A4F11700009623C9F10384E61AB8EBC492F10-
3E5E629B8E0C492C9F10319E62DB8D5C492F10-
33CE636B8CBC492F10357E63FB8C0C492F1036BE-
648B8B5C492F1037AE651B8ABC-
492F10386E65AB8A0C492F10391E663B895C492F10-
399E66CB88BC492F103A0E675B880C492F1-
03A7E67EB875C492F103AdE-
687B86BC492F103B2E690B860-
C492B855B96AF8A1B930D4A3B96AF1A8B940-
D4A383F8AFBE0827AAF1AB19F1AC27B867A018-
A018A0FF67AFF6DD97CF7ACFBF7ABFAF7AA-
EEB6B869F037F2D4C810F096D4C810B868F0A-
1C9C8F0A183B869F06CA0C8F07BA0C8F07AA0C4-
BBF8C6F1A4B6A4BEB871CAFAD31396FDBA0A-
FAA0B8712347142923461429238354B7230454B7F054-
B7235254B7234454B783C52799FCB807A0E8230937B-
22E8626043FB808F007A08400

The foregoing code is used by the microprocessor to assimilate all the inputs and convert them to an output form (in the general manner shown and described above in connection with FIG. 5), which is sent to a speech synthesizer 65. The speech synthesizer 65 then outputs voltage in an analog form to an amplifier 66 which adjusts the voltage level of the output with the aid of a potentiometer 78 that is used to control speaker volume. The amplified voltage is then sent to the speaker 67 which outputs the data in an intelligible human-like voice. The speech synthesizer 65 may be a model DIGITALKER manufactured by National Semiconductor, for example, the use of which is well known to those skilled in the electronics art.

A series of parallel outputs are sent from the INTEL D8749 Microprocessor Chip to the National Semiconductor DIGITALKER speech synthesizer in a binary form, each output representing one of 256 words or phrases which make up the speech synthesizer's vocabulary. The vocabulary is stored in two 256K ROM chips connected to the speech synthesizer in a manner specified by the chip manufacturer.

In operation, there are two principal modes of operation that the user may select from the MODE selection switch 71, namely the DISTANCE AND DIRECTION mode and the TARGET mode.

In the DISTANCE AND DIRECTION mode the operator first hears through the speaker 77, "Please Start." He then sets the "stimp" calibration by adjusting the potentiometer 75 marked "Speed of Green Input" to the desired setting. The operator then places a golf ball 4 at the end of the putting surface 6, at the opposite end from the sensor housing 2 (as shown in FIG. 1). The operator then aims at the aiming mark 7 on the putting surface and hits the ball with his putter 5. The speech synthesizer provides an audible indication of total putt distance and deviation from the desired path. If the ball travels left of the aiming mark 7, a typical output heard through the speaker could be "Thirteen feet, Seven Inches; left, Two feet, Six inches." If the ball is right of the mark, a typical response could be "Fifty Two Feet, Eleven Inches, Right Four feet, Two Inches." If the ball travels directly over the mark, a typical output heard could be, "Thirty-Two feet, five inches, DEE-DOO DEE-DOO HOLE IN ONE." The ball, in the meantime, would have travelled back to the hitting area. If the ball was mishit and travelled at a very slow rate and just interrupted the first beam 15 or if the operator stuck his hand into the sensor housing, an output would be heard, "Out of Control, Please try again."

If the operator selects the TARGET mode by moving mode selector switch 71 to "TARGET" position, the operation is somewhat different. The machine initially outputs through the speaker 77, "Feet To Equal."

At this point the operator would depress the momentary switch 74 marked "SET TARGET DISTANCE" and would hear output from the speaker, "Ten, Twenty, Thirty, Forty, Fifty, Sixty, Seventy, Eighty, Ninety", which would be repeated until he releases the switch. At that point, the last number heard would be the target distance. The machine would respond through the speaker, "set for [target distance] feet. Please start." He then sets the "stimp" calibration by adjusting the potentiometer 75 marked "Speed of Green Input" to the desired setting. The operator then places a golf ball 4 at the end of the putting surface 6, at the opposite end from the sensor housing 2 (as shown in FIG. 1). The operator then aims at the aiming mark 7 on the putting surface and hits the ball with his putter 5. The speech synthesizer gives an audible indication of relative distance to target distance (short or long), relative deviation from the desired path (left or right) and the calculated distance remaining to the set target. If the ball travels left of the aiming mark, a typical output heard through the speaker could be "Minus, Left, Thirteen feet, Seven Inches" or "Plus, Left, Thirteen feet, Seven Inches", depending if the ball travels short (minus) of the set target distance or longer than (plus) the intended target distance. If the ball is right of the mark, a typical response could be "Minus, Right, Three Feet, Eleven Inches" or "Plus, Right, Three Feet, Eleven Inches." If the ball travels directly over the aiming mark but more than three feet past the intended target, a typical response would be "Seven Feet Two Inches". A similar response would be given if the ball travelled directly over the mark but was calculated as being short of the intended target. If the ball travelled over the direction mark and its calculated distance equalled the target distance or was less than three feet past, then a typical output heard could be, "DEE-DOO DEE-DOO, HOLE IN ONE." The ball in the meantime would have travelled back to the hitting area. If the ball was mishit and travelled at a very slow rate and just barely interrupted the first beam 15 or if the operator stuck his hand into the sensor housing, an output would be heard, "Out of Control, Please try again."

After the eighth response in the TARGET mode, the machine gives an output through the speaker of the average results of the preceding eight putts; a typical response being, "Eight Times Equals Three Feet, Seven Inches. Target Set for [target distance] Feet."

A variation of the invention is a device that utilizes the identical sensor housing, sensor arrangement and attached putting surface. The outputs from the sensors, however, are sent via cable to an input port (a joy stick port, for instance) of a personal computer. The personal computer has running software that makes all the necessary computations and calculations necessary to come up with distance and direction. For personal computers that lack an adequate means to time the sensor information in a precise and accurate fashion, electronics would be available on the invention that would convert the sensor information to distance and direction data and in turn would convey this data to the personal computer via a serial link. Once the person has the calculated distance and direction information about the user's golf putt, internal software would alter it to fit into the final presentation of the golf putt on the video screen. Some of the different presentations would be uphill, downhill, side hill simulations. Also the user could obtain various software that would present simulation of putting on different golf course's putting greens allowing the user to get a feel for and obtain prior knowledge of a golf resort's putting greens before he visits that resort. Also, the presentation could allow the user to see how he matches up to a historic putting round performed by some famous golfer (for instance, software that would represent the greens of Augusta National Golf Club during the 1986 Masters Tournament setting up the position of the golf ball on the same spot that the winner, Jack Nicklaus, had to put from; the user would them attempt to better Nicklaus' performance during that last round)

Another variation of the invention would be an arcade-style machine that allows the user to putt into the machine and see the simulated results of his putt on a video monitor. The machine would more than likely have a means of collecting payment from the user before he used the machine. In essence, the arcade-like machine would incorporate the same positioning and use of the sensors as the other variations of the invention did. The automatic ball return features would be built in and the same calculations would be used to ascertain distance and direction of the golf ball movement. The machine would present the information in much the same variations as described in other variations of the invention.

Another variation of the invention would be the use of pressure-sensitive strips or momentary contact-like switches laid across the width of the sensor housing in much the same pattern as the optical beams but positioned on top of or imbedded into the putting surface. When the golf ball would roll across the strips or switches information corresponding to the optical sensors' output used in the preferred embodiment of the invention would be attained.

I claim as my invention:

1. A device for diagnosing movement of a ball which is struck in a starting region to roll over a support surface and to cross first, second and third reference lines adjacent said surface, said first and second reference lines being sequentially crossed by the ball and being parallel to each other and perpendicular to a reference path and said third reference being at an acute angle relative to said reference path, said device comprising: first detector means for generating a first electrical signal as the ball crosses said first detection line; second detector means for generating a second electrical signal as the projectile crosses said second detection line; third detector means for generating a third electrical signal as the projectile crosses said third detection line; circuit means for processing said first, second and third electrical signals for developing indicating signals which indicate the speed and path of rolling movement of the ball over said support surface, and indicating means responsive to said indicating signals.

2. A device according to claim 1 wherein each of said first, second and third detector means is a photo electric device projecting a radiation beam along said respective detection lines between an emitter and a receptor that produces a changing electrical signal in response to interruptions of said beam.

3. A device according to claim 1 wherein said third detection line intersects said reference path at the point of intersection of at least one of said first or second detection lines.

4. A device according to claim 1 wherein said circuit means includes a source of clock pulses and a digital counter circuit that registers the number of clock pulses occurring during the movement of said ball between said first and second detection lines.

5. A device according to claim 1 wherein said second circuit means includes a source of clock pulses and a digital counter circuit that registers the number of clock pulses occurring during the movement of said ball between said third detection line and said predetermined one of said first or second detection lines.

6. A device according to claim 1 wherein said indicating means provides an indication of expected distance of travel for the ball.

7. A device according to claim 6 further comprising adjustment means between said counter means and said output means for varying the output indication that is generated in response to any predetermined number in said counter means.

8. A device according to claim 1, wherein said support surface is in the form of a floor surface defining said movement plane and including said reference path, said floor surface also having a predetermined surface texture for frictional engagement with said moving ball and a starting position in said starting region at which the ball is struck.

9. A device according to claim 8 further comprising means for returning the ball to its starting area once it has passed said detection lines.

10. A device according to claim 8 wherein said ball is a golf ball and wherein said floor surface has a surface texture approximating that of a putting green.

11. A device according to claim 10 wherein said indicating means include adjustment means calibrated in accordance with the "stimp" or rolling characteristics of a putting green.

12. A device according to claim 10 further comprising means for returning said golf ball to its starting area once it has passed said detection lines.

13. A device according to claim 12 wherein said returning means includes an inclined ramp extending upward from said plane at an angle beginning beyond said detection lines and a rebound surface merging with said ramp at the upper end thereof to define a nip for receiving said golf ball and absorbing the energy of movement therefrom such that the return of the ball to its starting area is predominantly determined by the slope of said return ramp.

14. A device for use in the practice of putting a golf ball, comprising:

(a) a housing for receiving a stroked putt and returning the same to the user, said housing having at least a top surface and a back surface that extends upwardly to a terminal end in proximity to said top surface and that extends at an acute angle to said top surface, and;

(b) a textured putting surface affixed to and extending down said back surface of said housing and horizontally along the bottom of said housing to define a path of movement for moving the golf ball, said housing top surface consisting of energy absorbent material.

15. A device according to claim 14 wherein said back surface meets the top surface of said housing at approximately sixy degrees and defines a "nip" therewith for temporarily securing a golf ball at the end of its forward travel and releasing the same for gravitational movement down the textured back surface.

16. A device according to claim 14 further comprising electronic sensing devices within said housing to detect the speed and direction of movement of a golf ball along said textured surface and output means responsive to said sensing devices for manifesting the speed and direction of movement to the user.

17. A device according to claim 14 wherein said energy absorbent material for the top surface is wood.

18. A device according to claim 14 for use in the practice of putting a golf ball wherein said textured putting surface extends a substantial distance from said housing to define a remote starting point for said putting.

19. A device according to claim 18 wherein said textured putting surface is flexible and adapted for storage within said housing when the device is not in use.

20. A device according to claim 18 wherein said textured putting surface has a predetermined starting area and wherein the texture of said putting surface and the angle of incline of said back surface of the housing are such that a golf ball released from the top of said back surface rolls approximately back to said starting area.

21. A method of obtaining velocity and positional information as to movement of a projectile in a path which is generally along a straight line in a reference plane and which may be at various positions relative to a reference line in said plane, said method comprising the steps of: establishing said reference plane for movement of the projectile, establishing first and second detection lines in parallel relation to each other in said reference plane and in perpendicular relation to said reference line, establishing at least one additional detection line in said plane and at an acute angle to said first and second detection lines, detecting first and second times at which the projectile intersects said first and second detection lines, detecting a third time at which the projectile intersects said additional detection line, determining the velocity of movement of the projectile in a direction parallel to said reference line from the difference between said first and second detection times, and determining the position of the path of movement of the projectile relative to said reference line from comparisons of said third detection time with said first and second detection times, said projectile being a ball and the establishing of said path for movement of the projectile being accomplished by providing a generally horizontal support surface for rolling movement of said ball thereover, and said reference plane being a generally horizontal plane in parallel relation to said support surface.

22. A method as defined in claim 21, wherein the projectile is a golf ball which is rolled over said horizontal support surface from a starting point on said surface toward a target point on said surface, said reference line being parallel to a line between said starting and target points, and said first, second and additional detection lines being between said starting and target points.

* * * * *